US008594355B2

(12) United States Patent
Guo

(10) Patent No.: US 8,594,355 B2
(45) Date of Patent: Nov. 26, 2013

(54) HEARING DEVICE WITH ADAPTIVE FEEDBACK SUPPRESSION

(75) Inventor: Meng Guo, Smørum (DK)

(73) Assignee: Oticon A/S, Smorum (DK)

( * ) Notice: Subject to any disclaimer, the term of this patent is extended or adjusted under 35 U.S.C. 154(b) by 483 days.

(21) Appl. No.: 12/700,889

(22) Filed: Feb. 5, 2010

(65) Prior Publication Data

US 2010/0202641 A1 Aug. 12, 2010

(30) Foreign Application Priority Data

Feb. 6, 2009 (EP) ..... 09152235

(51) Int. Cl.
*H04R 25/00* (2006.01)

(52) U.S. Cl.
USPC ..... 381/318; 381/71.11

(58) Field of Classification Search
USPC ..... 381/318, 317, 71.1, 93, 312, 314, 320, 381/321, 83
See application file for complete search history.

(56) References Cited

U.S. PATENT DOCUMENTS 6,134,329 A 10/2000 Gao et al.
6,560,332 B1 5/2003 Christensson et al.
6,665,410 B1 * 12/2003 Parkins ..... 381/71.1
2005/0163331 A1 * 7/2005 Gao et al. ..... 381/93
2006/0140429 A1 * 6/2006 Klinkby et al. ..... 381/317
2008/0298615 A1 * 12/2008 Klinkby et al. ..... 381/318
2009/0067654 A1 * 3/2009 Klinkby et al. ..... 381/318
2009/0097681 A1 * 4/2009 Puria et al. ..... 381/318

FOREIGN PATENT DOCUMENTS

EP 1 191 814 A1 3/2002
EP 2 003 928 A1 12/2008

* cited by examiner

*Primary Examiner* — Duc Nguyen
*Assistant Examiner* — Phan Le
(74) *Attorney, Agent, or Firm* — Birch, Stewart, Kolasch & Birch, LLP

(57) ABSTRACT

This invention relates to a hearing device for compensating hearing impairment of a user. The hearing device comprises an input signal converter for converting an acoustic signal to an electric signal, a signal processor, an output signal converter for converting a processed signal to a processed acoustic signal presented to the user, and an adaptive feedback suppression unit compensating for acoustic feedback between the output signal converter and the input signal converter and to generate a feedback compensation signal, which is mixed with the electric signal from the input signal converter to provide a compensated electric signal. The signal processor is adapted to process the compensated electric signal and to generate a processed signal therefrom. The hearing device further comprises an open loop approximation unit adapted to monitor relation between the compensated electric signal and the processed signal, and adapted to generate a control signal based on the relation, the control signal controlling the signal processor and/or the adaptive feedback suppression unit.

20 Claims, 4 Drawing Sheets

HEARING DEVICE WITH ADAPTIVE FEEDBACK SUPPRESSION

The invention relates to a hearing device—also known as hearing aid—or parts thereof, and to a method for providing a better audible signal to a user of such hearing device. Typical hearing devices are in-the-ear (ITE) devices, completely-in-canal (CIC) devices, behind-the-ear (BTE) devices or receiver-in-the-ear (RITE) devices.

More particularly, the invention relates to a hearing device capable of adaptive feedback suppression of acoustic feedback in the hearing device.

Figure 1:
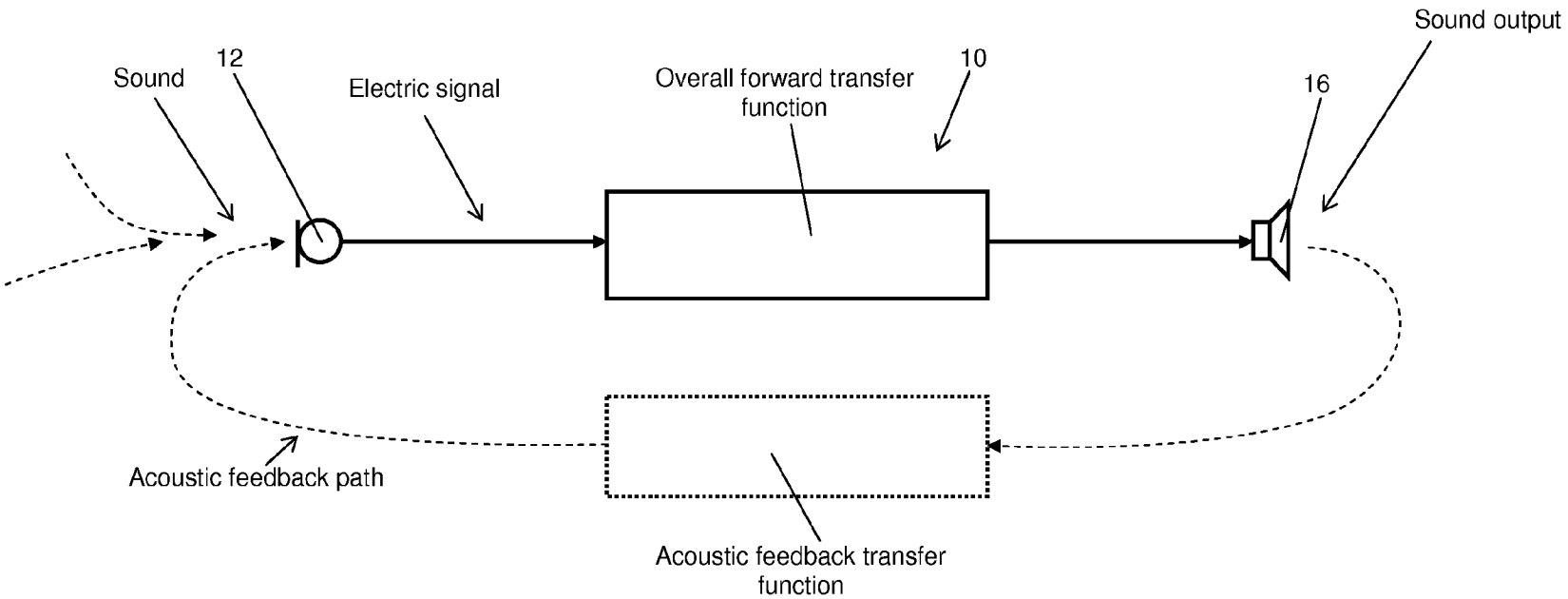
Fig. 1 (Prior Art)

Such hearing device, as shown in FIG. 1 in entirety as reference numeral 10, comprises an input signal converter 12 for converting an acoustic input into an electrical signal. The input signal converter 12 may be a microphone and may also be called an input signal transducer. The hearing device 10 generally processes the electric input signal to generate an electric output signal that is fed to an output signal converter 16, which converts the output electric signal into an acoustic output. The output signal converter 16 may be a speaker and may also be called an output signal transducer. In the art, such output signal converter is generally known as receiver.

Processing of the electric input signal usually entails compensating a specific hearing impairment of a user; that is, the amplification is controlled so as to accommodate for a particular user's hearing loss. When the hearing device 10 is worn by a user, acoustic output from the output signal converter 16 may be fed back to the input signal converter 12, which potentially causes the generation of undesired acoustic signals presented to the user of the hearing device 10. In particular, such feedback of acoustic output from the speaker to the microphone may lead to acoustic feedback instability resulting in a phenomenon called howling or whistling.

Acoustic feedback instability is dependent on the open loop transfer function of the hearing device 10, when hearing device 10 is placed on the user, namely dependent on the fact that the open loop gain shall be less than one (0 dB) and the open loop phase different than whole multiples of 360° to avoid instability. Open loop transfer function (sometimes called loop gain) is defined as the product of the overall forward transfer function (including the transfer functions of the microphone and the receiver) and the acoustic feedback transfer function (see FIG. 1).

Figure 2:
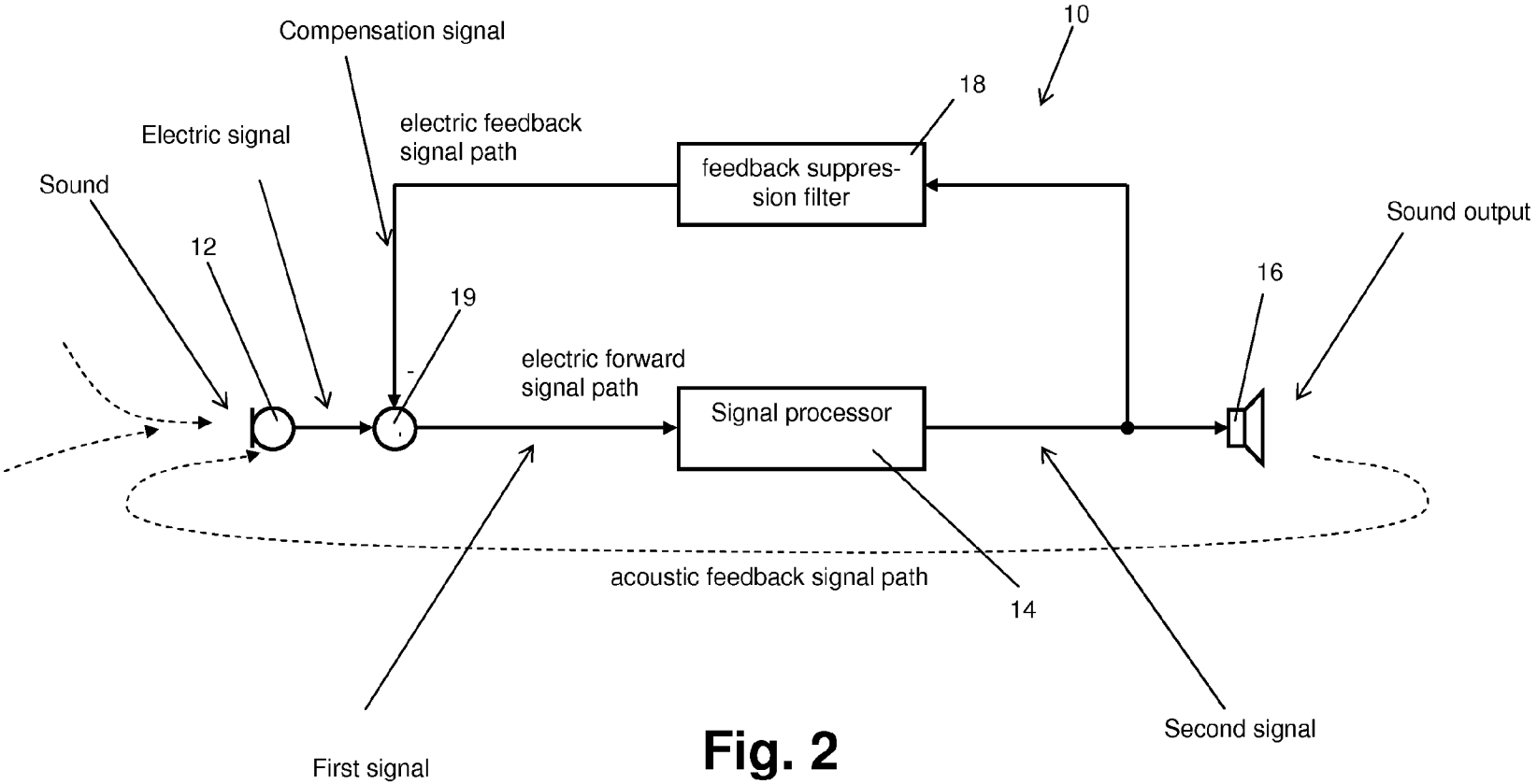
Fig. 2 (Prior Art)

In order to prevent howling, it is known to implement a feedback suppression filter 18 into the hearing device 10 as shown in FIG. 2. While the electric input signal is processed by a signal processor 14 in an electric forward signal path, the feedback suppression filter 18 usually is arranged in an electric feedback signal path. Thus, the acoustic feedback is measured during a setting phase and the filter coefficients of the feedback suppression filter 18 are set so as to reduce the acoustic feedback in a particular situation, and the feedback suppression filter 18 generates a compensation signal, which is mixed with the input signal by a mixer 19 (e.g., as shown, a sum unit) so as to suppress the acoustic feedback.

It is also known to provide a hearing device with an adaptive feedback suppression filter that adaptively compensates for the varying acoustic feedback experienced by a hearing device used by a wearer in different acoustic environments. In order to efficiently compensate for the acoustic feedback, the acoustic feedback transfer function (see FIG. 1) is estimated by using techniques based on Least-Mean-Square (LMS), Recursive-Least-Squares (RLS) or the like. If the estimated acoustic feedback transfer function is identical to the real acoustic feedback transfer function, then a perfect cancellation of the acoustic feedback is possible. In such a case, there is no limit for the gain of the overall forward transfer function (see FIG. 1). This fact follows from the relationship between open loop transfer function and instability as described above. Hence when ideally the adaptive feedback suppression filter performs a perfect cancellation, the acoustic feedback transfer function is zero, and there are no restrictions to the overall forward transfer function.

However, in real situations, it is not possible to entirely cancel the acoustic feedback by means of an adaptive feedback suppression filter 18. Therefore, the transfer function of the signal processor 14 is typically limited to some function of the residual acoustic feedback in the acoustic feedback transfer function in order to keep the open loop gain below one (0 dB). The residual acoustic feedback is to be construed as the acoustic feedback remaining following compensation by the adaptive feedback suppression filter 18, i.e. the acoustic feedback transfer function is not zero. The overall forward transfer function of the hearing device 10 depends on the electric signal forward path and the electric signal feedback path in the hearing device. Since full compensation of the acoustic feedback in reality is never achieved, using an adaptive feedback suppression filter 18 allows for an increased but limited gain in the overall forward transfer function.

US 2006/0245610 describes an automatic gain adjustment for a hearing device. According to this publication, the gain in the electric forward signal path is limited by some stored gain limit value. If the desired gain exceeds the stored value, then the resulting gain is limited. In this way, using appropriate stored gain limit values, the loop gain is under control and howling is avoided.

WO 2006/063624 describes a model gain estimator generating an upper gain limit in the electric forward signal path by determining the gain of an adaptive feedback suppression filter. The determination of the gain in the adaptive feedback suppression filter (the model gain) is carried out by comparing the level of the electrical output signal to the level of the feedback cancellation signal. The level of each of these signals is estimated as a norm within a selected time frame. The derived level difference between the electric output signal and the feedback cancellation signal is then used as an estimate for the model gain. Thus the upper gain limit in the electric forward signal path is determined by merely estimating the acoustic feedback gain and not by trying to estimate the loop gain of the hearing aid.

According to EP 1 191 814, a first and a second adaptive filter is used. The second adaptive filter provides a faster convergence rate compared to the adaptive feedback suppression filter and is utilized to estimate the residual acoustic feedback transfer function, which estimate is used for controlling the gain in the electric forward signal path and/or convergence rate in the adaptive feedback suppression filter.

It is an object of the invention to provide a hearing device having improved acoustic feedback suppression.

According to a first aspect of the invention, this object is achieved by a hearing device for compensating for a hearing impairment of a user, and comprising an input signal converter adapted to convert an acoustic signal to an electric signal, an output signal converter adapted to convert a processed signal to a processed acoustic signal presented to the user, an adaptive feedback suppression unit adapted to compensate for acoustic feedback between the output signal converter and the input signal converter and to generate a feedback compensation signal, which is added to the electric signal generating a compensated electric signal, and a signal processor adapted to process the compensated electric signal and to generate the processed signal, the hearing device further comprising an open loop approximation unit adapted to monitor a relation between the compensated electric signal and the processed signal, and adapted to generate a control signal based on the relation, the control signal controlling the signal processor and/or the adaptive feedback suppression unit.

The open loop approximation unit thus determines from this relation an estimate of the residual acoustic feedback, i.e. the difference between the acoustic feedback transfer function (FBG) and the electric feedback transfer function ($FBG_{est}$) provided by the adaptive feedback suppression filter. The advantage is thus that the open loop approximation unit continuously monitors the effect of the adaptive feedback suppression filter and controls the signal processor and/or the adaptive feedback suppression filter accordingly.

The term "transfer function" is in this context to be construed as the relation between output and input, and shall not be limited to linear time invariant (LTI) system, therefore including non-linear time variant systems. The transfer function in this context also refers to a relation between output and input at an instant in time.

In addition, and/or alternatively, the open loop approximation unit further may be adapted to monitor a signal processor transfer function. The open loop approximation unit may thus be adapted to determine an open loop transfer function from a multiplication between the relation between the compensated and processed signal and the signal processor transfer function. Hence the open loop approximation unit advantageously determines the open loop transfer function. If the result of the adaptive feedback suppression unit is far from optimal, it may be reflected by a large open loop gain and then different actions can be taken to minimize the risk for feedback instability.

The open loop approximation unit can e.g. be implemented using a linear prediction model. The sub-band receiver signal is e.g. used for predicting the sub-band first signal. The linear predictor coefficients can effectively be predicted using a least mean square method, which results in a closed form solution of the coefficients and thereby a closed form result of the maximum allowable loop gain for ensuring stability of the overall system. Linear prediction models are e.g. discussed in [Makhoul; 1975].

The loop gain approximation unit may be used either as a detector or as a controlling unit for the signal processing system (or both). As a detector the open loop gain approximation unit can be used for acoustic feedback cancellation control, as an on-the-fly loop gain estimator. As a controlling unit the loop gain approximation unit can actively control the maximum allowable gain at any given time-instant in both static and dynamic HA usage scenarios.

The open loop gain LG(t) or LG(f,t) can be expressed as a product of the gain G(t) or G(f,t) of the signal processor (representing the specific gain, e.g. as requested according to a user's hearing impairment, compression and/or other appropriate audio processing algorithms), from its input $SP_{IN}$ to its output $SP_{OUT}$ to the input $SP_{IN}$ of the signal processor LG=G·FBG, f being frequency, t being time. The input $SP_{IN}$ and output $SP_{OUT}$ values of the signal processor are in general the complex values of the signals (X=MAGNITUDE(X)+i·PHASE(X), where X is the complex signal and 'i' is the complex unit fulfilling the relation $i^2=-1$; alternatively X can be expressed as $X=|X|\cdot e^{i\cdot\Phi}$, where |X|=MAGNITUDE(X) and $\phi$=PHASE(X)). In general, loop gain and feedback gain are complex functions. In an embodiment, only the magnitudes of the signals are considered.

Further, the open loop approximation unit may be adapted to communicate the relation between the compensated ($SP_{IN}$) and processed ($SP_{OUT}$) signal to/from the signal processor, and the signal processor may be adapted to calculate an open loop transfer function (LG) from a multiplication between the relation ($SP_{IN}/SP_{OUT}$) between the compensated and processed signal and the signal processor transfer function (G) ($LG=(SP_{IN}/SP_{out})\cdot G=FBG\cdot G$). Obviously, this further aspect provides an alternative having similar advantages.

When the open loop approximation unit determines an open loop gain close to one (0 dB) or larger the open loop approximation unit may generate a control signal. The control signal may be forwarded to the signal processor so as to cause an adjustment of the signal processor transfer function such as reduction of the maximum gain ($G_{max}(f)$) of the signal processor or adjustments in the gain frequency relationship (G(f)) until the open loop gain again becomes smaller than one (0 dB). Alternatively and/or additionally, the control signal may be forwarded to the adaptive feedback suppression unit so as to cause an adjustment of filter parameters according to the control signal; for example, the filter parameters may comprise values for controlling convergence speed (as e.g. determined by a step size $\mu$ of the algorithm) of the adaptive feedback suppression unit.

In an embodiment, the open loop approximation unit has a faster adaptation time than the adaptive feedback suppression filter. In an embodiment, the open loop approximation unit is adapted to determine a residual acoustic feedback faster than the adaptive feedback suppression filter is adapted to estimate the current acoustic feedback. In an embodiment, the open loop approximation unit comprises an adaptive filter equivalent to that of the adaptive feedback suppression filter (cf. 18, 20 in FIG. 3) of the electric feedback signal path. The estimate of the acoustic feedback path provided by the adaptive feedback suppression filter of the electric feedback signal path is used to compensate the input signal (electric signal of FIG. 3, cf. SUM unit 19 in FIG. 3), whereas the open loop approximation unit only estimates the acoustic feedback path (and possibly uses the estimate to control an adaptation speed of the adaptive feedback suppression filter and/or the maximum gain of the signal processor).

In an embodiment, the hearing device is adapted to modify (increase) the adaptation speed of the adaptive feedback suppression filter in case of a sudden change (e.g. within ms or s) of the acoustic environment (e.g. due to a different kind of sound environment) and/or of the acoustic feedback conditions. In an embodiment the hearing device is adapted to provide that such modification of the adaptation speed of the adaptive feedback suppression filter is performed when the residual acoustic feedback and/or the open loop gain is larger than a first predefined level. In an embodiment the device is adapted to provide that such modification of the adaptation speed of the adaptive feedback suppression filter is performed within 10 ms, such as within 50 ms, such as within 100 ms, such as within 500 ms, of the detection of a residual feedback and/or the open loop gain larger than the first predefined level.

In an embodiment, the hearing device is adapted to provide that the maximum gain $G_{max}$ that is allowed at any point in time in the signal processor is modified (reduced) to reduce the risk of howl. In an embodiment the device is adapted to provide that such modification of the maximum gain of the signal processor is performed when the residual acoustic feedback and/or the open loop gain is larger than a second predefined level. In an embodiment, the second predefined level is larger than the first predefined level.

In an embodiment, the open loop approximation unit is adapted to monitor a residual acoustic feedback and/or the open loop gain over time. In an embodiment, the open loop approximation unit is adapted to provide a residual acoustic feedback and/or the open loop gain averaged over a certain averaging time, e.g. a running average. In an embodiment, the averaging time is larger than 1 minute, such as larger than 500 s, such as larger than 1 hour, such as larger than 4 hours, such as larger than 1 day. In an embodiment, the open loop approximation unit is adapted to determine a rate of change of residual acoustic feedback and/or open loop gain.

In an embodiment, the hearing device is adapted to provide that the maximum gain $G_{max}$ that is allowed at any point in time in the signal processor is modified (reduced) in case of a slow change (e.g. within minutes or hours or days) of the acoustic feedback conditions (e.g. due to changes in the fitting of the apparatus in the ear canal). In an embodiment the hearing device is adapted to provide that such modification of the maximum gain $G_{max}$ is performed when the average residual acoustic feedback and/or the average open loop gain is larger than a third predefined level. In an embodiment the device is adapted to provide that such modification of the maximum gain $G_{max}$ is performed when the average residual feedback and/or the average open loop gain has been larger than the third predefined level for a predefined averaging time.

In an embodiment, the hearing device is adapted to provide that the maximum gain $G_{max}$ that is allowed at any point in time in the signal processor is modified (reduced) in case of a rate of change of the residual acoustic feedback and/or of the open loop gain is larger than a first predetermined rate of change. In an embodiment the hearing device is adapted to provide that the adaptation speed of the adaptive feedback suppression filter is modified (e.g. reduced) when the residual acoustic feedback and/or the open loop gain is larger than a second predetermined rate of change.

The open loop approximation unit may determine open loop gain ($|LG|$) and phase ($\phi_{LG}$), and may be adapted to generate a control signal when the open loop gain is greater than or equal to one and/or when the open loop phase is 0° or an integer number times 360°. In an embodiment, the loop approximation unit is adapted to generate a control signal when the open loop gain is greater than or equal to 0.9 and/or when the open loop phase is 0°+/−10° or an integer number times 360°+/−10°. The open loop approximation unit may further be adapted to generate a control signal when the open loop gain is greater than 0.3, such as greater than 0.4, 0.5, 0.6, 0.7, 0.8, 0.9, 1.0, 1.1, or 1.2. Hence the open loop approximation unit is capable of generating a control signal for compensating for potential instability; i.e. initiate compensation procedures, such as reducing gain of the signal processor or adjusting convergence speed of the adaptive feedback suppression unit, before instability has actually occurred. The compensation procedures may be performed as a stepwise reduction of gain or adjustment of filter parameters.

The signal processor may be arranged in the electric forward signal path, while the adaptive feedback suppression unit may be arranged in the electric feedback signal path. The adaptive feedback suppression unit may receive the processed signal input to the output signal converter and generate a feedback compensation signal that is fed back to a mixing unit (e.g. a sum unit) interconnecting input signal converter and the signal processor and adapted to mix the feedback compensation signal with the electric signal.

As known in the art, the adaptive feedback suppression unit may be implemented as a filter connected to a filter control unit that may generate an adaptive translation algorithm to control the filter characteristics of the adaptive feedback suppression filter (cf. e.g. [Engebretson, 1993]). A filter control unit may have two input ports, a first filter control unit input port, which may be connected to the signal processor's input port, and a second filter control input port, which may be connected to the signal processor's output port. The filter (as the filter control unit) may be connected at one side to the signal processor's output port and on the other side to the mixing unit (e.g. a sum unit). Hence the filter control unit senses on the input and output signals of the signal processor and based thereon determines filter characteristics of the filter generating a simulation of the acoustic feedback from the processed signal. Adaptive filters in general are e.g. discussed in [Haykin; 1996].

The full (audio) frequency range considered by the hearing device constitutes a part of the human audible frequency range (20 Hz-20 kHz), such as e.g. the range from 20 Hz to 8 kHz or to 10 kHz or to 12 kHz).

The hearing device according to the first aspect of the invention may be either a full band device or a sub band device and may comprise one or more signal processors. In a sub band device, the frequency range considered is split into a number of frequency bands (e.g. 2 or more, such as e.g. 8 or 64 or 256 or 512 or 1024 or more), where at least some of the bands are processed individually. Thus the hearing device may further comprise a filterbank for dividing the compensated electric signal into a plurality of sub-band electric signals and the signal processor may be adapted to concurrently process the plurality of sub-band electric signals and mix (e.g. by weighting and adding or subtracting or by simply adding or subtracting) the plurality of processed sub-band electric signal into the processed signal. In a full band device comprising a single processor, that processor would be adapted to process signals over a full audio frequency band. If the hearing device comprises a plurality of signal processors, each of the signal processors processes a predetermined sub-band of the electric signal.

Alternatively, the hearing device may comprise a filterbank for dividing the electric signal into a plurality of sub-band electric signals, the adaptive feedback suppression unit being adapted to compensate for acoustic feedback between the output signal converter and the input signal converter in each sub-band and to generate a sub-band feedback compensation signal, which is mixed with (e.g. subtracted from) the sub-band electric signal generating a compensated electric signal for each sub-band, and the signal processor may be adapted to concurrently process the plurality of compensated electric signals for each sub-band and mix (e.g. add) the plurality of processed signals for each sub-band into the processed signal. Hence the hearing device advantageously may compensate for acoustic feedback in the sub-bands.

The signal processor may comprise an amplifier for applying gain to the electric signal and preferably further may comprise a filter for filtering the electric signal.

A method of operating a hearing device for compensating hearing impairment of a user is furthermore provided, the hearing device comprising an input signal converter adapted to convert an acoustic signal to an electric signal, an output signal converter adapted to convert a processed signal to a processed acoustic signal presented to the user, and a signal processor adapted to process the compensated electric signal and to generate the processed signal therefrom, the method comprising

- Providing adaptive feedback suppression to compensate for acoustic feedback between the output signal converter and the input signal converter;
- Generating a feedback compensation signal,
- Mixing the feedback compensation signal with the electric signal thereby generating a compensated electric signal,
- Monitoring a relation between the compensated electric signal and the processed signal, Generating a control signal based on the relation for controlling the signal processor and/or the adaptive feedback suppression.

It is intended that the structural features of the device described above, in the detailed description and in the claims can be combined with the method, when appropriately substituted by a corresponding process and vice versa. Embodiments of the method have the same advantages as the corresponding devices.

In an embodiment, the relation between the compensated electric signal and the processed signal is used to determine a residual acoustic feedback and/or the open loop gain. In an embodiment, the determination of the residual acoustic feedback and/or the open loop gain is faster than the generation of the feedback compensation signal.

In an embodiment, a first predefined level is defined. In an embodiment, the control signal is used to modify (reduce) the adaptation speed of the generation of the feedback compensation signal, if the residual acoustic feedback and/or the open loop gain is larger than the first predefined level.

In an embodiment, a second predefined level is defined. In an embodiment, the control signal is used to modify (reduce) the maximum gain $G_{max}$ that is allowed at any point in time in the signal processor, if the residual acoustic feedback and/or the open loop gain is larger than the second predefined level.

In an embodiment, the residual acoustic feedback and/or the open loop gain is monitored over time. In an embodiment, an average residual acoustic feedback and/or an average open loop gain is determined. In an embodiment, the averaging time is larger than 1 minute, such as larger than 500 s, such as larger than 1 hour, such as larger than 4 hours, such as larger than 1 day.

In an embodiment, a third predefined level is defined. In an embodiment, a first averaging time is defined. In an embodiment, the control signal is used to modify (reduce) the maximum gain $G_{max}$ that is allowed at any point in time in the signal processor, if the average residual feedback and/or the average open loop gain has been larger than the third predefined level for the first predefined averaging time.

In an embodiment, a fourth predefined level is defined. In an embodiment, a second averaging time is defined. In an embodiment, the control signal is used to modify (increase) the maximum gain $G_{max}$ that is allowed at any point in time in the signal processor, if the average residual feedback and/or the average open loop gain has/have been smaller than the fourth predefined level for the second predefined averaging time.

A tangible computer-readable medium storing a computer program comprising program code means for causing a data processing system to perform at least some (such as a majority or all) of the steps of the method described above, in the detailed description and in the claims, when the computer program is executed on the data processing system is furthermore provided by the present application. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A data processing system comprising a processor and program code means for causing the processor to perform at least some (such as a majority or all) of the steps of the method described above, in the detailed description and in the claims is furthermore provided by the present application. In an application, the data processing system form part of a hearing device. In an application, the data processing system form part of a hearing device as described above, in the detailed description and in the claims.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

Further preferred embodiments of the hearing device will become apparent from the following detailed description of an exemplary embodiment of the invention.

Figure 3:
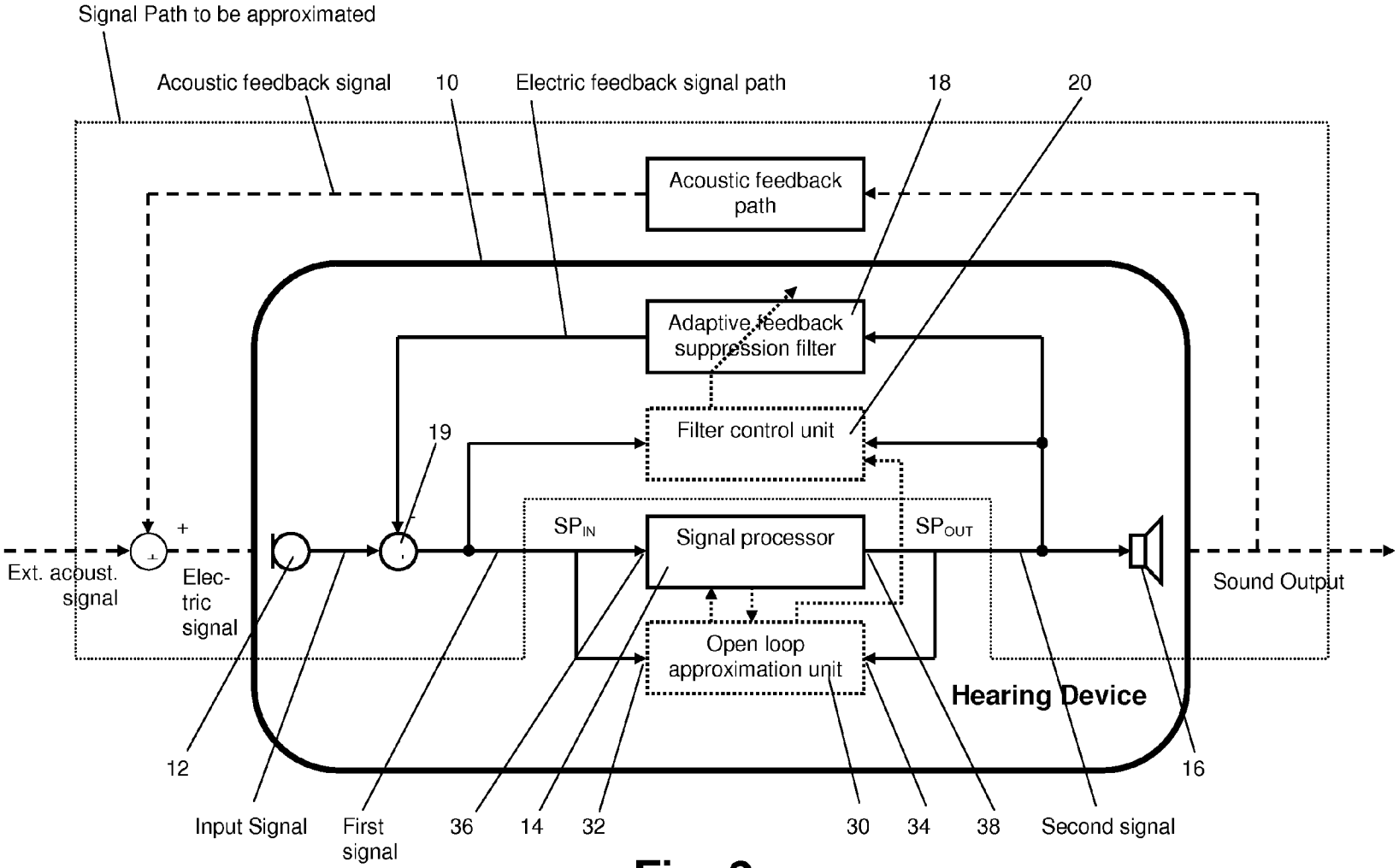
Figure 4:
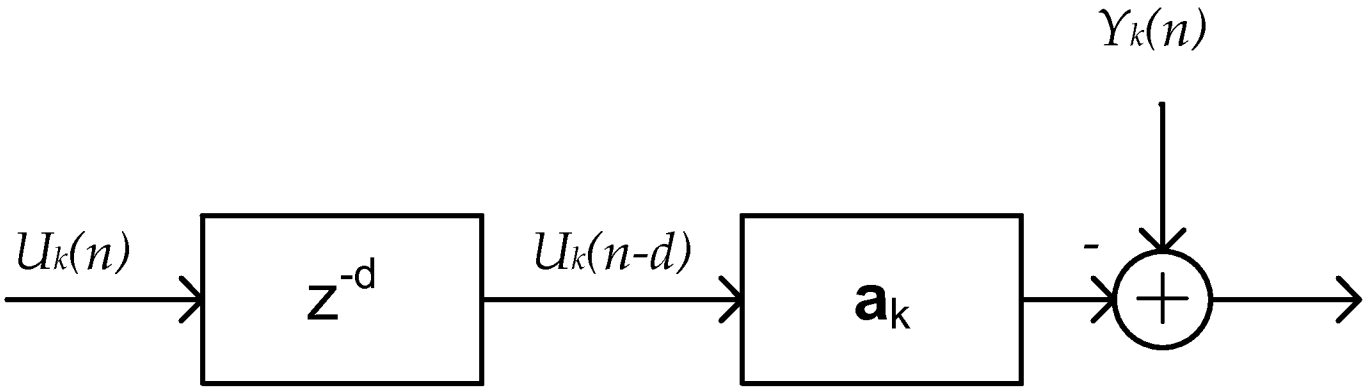

The invention shall now be further illustrated with respect to the figures. Of these figures, FIG. 1: shows a schematic overview of a prior art hearing device; and FIG. 2: shows a schematic overview of a prior art hearing device with feedback suppression capability;

FIG. 3: shows a schematic block diagram of hearing device according to an embodiment of the invention illustrating the signal paths to be considered; and FIG. 4: shows a feedback gain estimator forming part of an open loop approximation unit.

FIG. 1 shows a schematic overview of a prior art hearing device 10 receiving sound at a microphone 12 generating an electric signal processed in accordance with the overall forward transfer function and forwarded to a speaker 16 converting the processed signal back into a sound output. Some of the sound output returns to the microphone 12 through an acoustic feedback path and in dependence on the acoustic feedback transfer function the returned sound output may cause instability of the hearing device 10.

FIG. 2 shows a further schematic diagram of a prior art hearing device 10, featuring a feedback suppression filter 18. The hearing device 10 comprises a microphone 12 for picking up sound and converting the sound into an electric signal. The electric signal contributes to a first signal that is fed to a signal processor 14. The signal processor 14 is adapted to process the first signal in order to generate a second signal that forms a processed signal and that is fed to a speaker 16. Thus, the signal processor 14 is arranged in an electric signal forward path.

The signal processor 14 usually comprises at least an amplifier for applying gain to the first signal in order to generate the second signal that is amplified compared to the first signal. The signal processor 14 may further comprise filters, such as band-pass filters, to filter the first signal. In multiband devices, a plurality of signal processors may exist in the hearing device. Each signal processor would then treat a separate frequency band (a separate sub-band) of the frequency spectrum of the first signal (not shown).

In a regular operational environment of the hearing device 10, the sound emerging from speaker 16 is directed to a user's tympanic member in the ear canal. The microphone 12 is placed so as to pick up sound from the user's ambient sound environment. However, some of the sound of the speaker 16 may be fed back to the microphone 12 and, thus, picked up by the microphone 12 together with sound from the ambient sound environment. Therefore, an acoustic feedback signal path exists that may lead to an acoustic feedback instability in the hearing device 10. This may cause an effect called howling. Two conditions must be fulfilled before the acoustic feedback instability occurs: The open loop gain exceeds one (0 dB) and the open loop phase is any whole multiple of 360°. The loop under consideration is the loop formed by a forward signal path of hearing device 10 having a transfer function between microphone 12 and receiver 16 and the acoustic feedback signal path having a transfer function between receiver 16 and microphone 12. The open loop transfer function, thus, is the product of the forward transfer function (G(f,t)) of the hearing device 10 and the acoustic feedback transfer function (FBG(f,t)).

In order to compensate for acoustic feedback, a feedback suppression filter 18 is provided. The feedback suppression filter 18 has a filter input port connected to the output port of signal processor 14 and, thus, receives the second signal. Feedback suppression filter 18 generates a filter output signal that ideally is inverse or identical to the electrically converted acoustic feedback signal and is added to or subtracted from, respectively, the electric signal and, thus, ideally compensates any contribution of the acoustic feedback signal to the electric signal. In that case, the first signal would be free of any feedback signal. The feedback suppression filter 18 is arranged in an electric feedback signal path.

As already pointed out, the transfer function of the electric feedback signal path would ideally be an inverse of the transfer function of the acoustic feedback signal path and the transfer functions of microphone 12 and receiver 16. In state of the art hearing devices, the feedback suppression filter 18 is an adaptive feedback suppression filter. Such adaptive feedback suppression filter is capable of adapting to an estimate of the feedback path and, therefore, is more capable of compensating for acoustic feedback than a feedback suppression filter with fixed filter characteristics. In order to adapt the filter characteristics of the adaptive feedback suppression filter 18, a filter control unit 20 (such as shown in FIG. 3) is provided, that performs an estimation of the transfer function of the acoustic feedback path by using techniques based on Least Mean Squares (LMS), Recursive Least Squares (RLS) or the like to control an adaptive cancellation algorithm performed by the adaptive feedback suppression filter 18 (cf. e.g. [Haykin; 1996]). The filter control unit 20 ensures an adaptation of the adaptive feedback suppression filter 18 according to a convergence speed. The higher the convergence speed the faster the adaptive feedback suppression filter simulates the acoustic feedback, however the more sensitive (but the less accurate) the adaptive system is. The lower the convergence speed the slower the adaptive feedback suppression filter simulates the acoustic feedback, which may result in the presentation of whistling sounds to the user.

FIG. 3 shows a schematic block diagram of a hearing device 10 according to an embodiment of the invention. In FIG. 3, a more detailed illustration of the adaptive feedback suppression filter is given. The adaptive feedback suppression filter 18 is controlled by a filter control unit 20 as pointed out above. The adaptive feedback suppression filter 18 is part of the electric feedback signal path that has a variable transfer function due to the adaptive nature of the feedback suppression filter 18. The novel feature of hearing device 10 shown in FIG. 3 is an open loop approximation unit 30 that is adapted to carry out an open loop approximation algorithm in order to determine the transfer function of a residual feedback i.e. feedback remaining in the system subsequent to compensation by the adaptive feedback suppression filter. By estimating the residual feedback, the open loop approximation unit 30 is able to determine whether or not the adaptive feedback suppression filter 18 actually can compensate for the acoustic feedback.

Hence the open loop approximation unit 30 determines the relation between the first signal and the second signal (i.e. the input signal $SP_{IN}$ to the signal processor 14 relative to the output signal $SP_{OUT}$ of the signal processor 14). In order to determine the open loop transfer function the open loop approximation unit 30 further connects to the signal processor 14 and performs a multiplication of the relation between the first and second signal ($SP_{IN}/SP_{OUT}$) and the signal processor transfer function (G) received by the open loop approximation unit 30 from the signal processor 14. In case the open loop gain is close to one (0 dB) or larger and the wrapped open loop phase is close to 0°, the open loop approximation unit 30 generates a control signal.

The open loop approximation unit 30 communicates the control signal to the signal processor 14 so as to control the transfer function (G) of the signal processor 14; e.g. changing the maximum gain ($G_{max}$) of the signal processor 14 or changing the filtering performed on the first signal by signal processor unit 14. In a further embodiment of the open loop approximation unit 30, the open loop approximation unit 30 communicates a control signal to the filter control unit 20 so as to control convergence speed of the adaptive feedback suppression filter 18 and/or filter control unit 20 (e.g. a step size of an LMS- or an RLS-algorithm).

In a typical normal mode of operation of the hearing device, the acoustic environment and the acoustic feedback conditions of the user are relatively stable. In such case the adaptation speed of the adaptive filter 18, 20 is relatively slow (e.g. to save power and/or avoid the creation of artifacts).

In case of a sudden change (e.g. within ms or s) of the acoustic environment (e.g. sudden changes in speech or noise signals) and/or of the acoustic feedback conditions (e.g. changes in the fitting of the apparatus in the ear canal and/or of reflections close to the hearing device, e.g. the sudden proximity of a telephone or a hat), the open loop approximation unit 30 (being in general adapted to react relatively faster than the adaptive filter) is adapted to modify (increase) the adaptation speed of the adaptive filter to be able to cope with the changing feedback conditions and thus avoid howl. Alternatively or additionally, one or more of the filter coefficients may be modified depending on the control signal from the open loop approximation unit 30. The detection of a (sudden) change of the acoustic operating conditions of the hearing device is done by identifying an increase in residual acoustic feedback (not presently compensated by the adaptive filter). This is e.g. done by making a correlation analysis of the first and second signals of the hearing device 10 (e.g. determining the cross-correlation between the input ($SP_{IN}$) and the output ($SP_{OUT}$) of the signal processor 14). This detection can e.g. be implemented in the same way as the implementation of the adaptive algorithm (cf. Filter control unit 20) of the adaptive filter (only with a faster adaptation sped).

In case of a slow change (e.g. within minutes or hours or days) of the acoustic feedback conditions (e.g. due to changes in the fitting of the apparatus in the ear canal, e.g. due to physical movements, e.g. in connection with exercise), the adaptive feedback system may not be able to avoid howl with the current settings of the hearing device. In such case the detection by the open loop approximation unit 30 of a residual acoustic feedback of a certain predefined size, a control signal provided by the open loop approximation unit 30 is used in the signal processor 14 to modify (reduce) the maximum gain $G_{max}$ that is allowed at any point in time.

In an embodiment, when the open loop approximation unit 30 detects a residual acoustic feedback of a certain predefined size, control signals provided by the open loop approximation unit 30 are used in the signal processor 14 to modify (reduce) the maximum gain $G_{max}$ that is allowed at any point in time and in the filter control unit to modify (increase) the adaptation speed of the adaptive filter 18, 20 to be able to cope with the changing feedback conditions and thus avoid howl. Alternatively or additionally, one or more of the filter coefficients may be modified depending on the control signal from the open loop approximation unit 30.

In an embodiment, the hearing device comprises a detector for identifying a frequency or a frequency band with a relatively high risk of experiencing howl at a given point in time.

In an embodiment, the open loop approximation unit is implemented using a linear prediction model. FIG. 4 shows the linear predictor system. $Y_k(n)$ is the compensated signal for a sub-band k ($SP_{IN}$ in FIG. 3), which is predicted by the delayed (d samples) processed signal ($U_k(n)$ ($SP_{OUT}$ in FIG. 3)). The complex predictor coefficients ($a_k$) estimate the feedback gain in a specific sub-band k at some time instant n. The predictor coefficients—and hence the feedback gain estimate—can be computed effectively using a least mean square method, which results in a closed form solution of the feedback gain estimate. The simplest scenario one can consider is a first order model. For a first order model, the least mean square solution is proportional to a multiplication between the compensated and processed signal ($Y_k(n)$ and $U_k(n)$, respectively) for a given sub-band k. The predictor system is illustrated by means of a $0^{th}$ order filter (e.g. a FIR-filter). Alternatively, the predictor system may be implemented as a higher order filter, which makes it more precise, but also more complex with respect to processing power.

In order to perform an estimate of the residual feedback transfer function, the open loop approximation unit 30 comprises a first open loop approximation unit input port 32 that receives the first signal ($SP_{IN}$) and a second open loop approximation unit input port 34 that receives the second signal ($SP_{OUT}$). For example, the first open loop approximation unit input port 32 may be connected to the signal processor's input port 36 and the second open loop approximation unit input port may be connected to the signal processor's output port 38. Thus, the open loop approximation unit input signals are directly taken from the (compensated) electric signal and the processed signal. In addition, the open loop approximation unit 30 connects to the signal processor 14 and receives data representing the signal processor transfer function (G), and utilises these data to determine the open loop transfer function. Obviously, in an alternative embodiment the open loop approximation unit 30 communicates data representing the residual feedback transfer function to the signal processor 14, which subsequently performs a multiplication between the residual feedback transfer function and the signal processor transfer function, thereby determining the open loop transfer function and when necessary control the signal processor transfer function and/or the filter control unit accordingly. In a practical implementation, signal processor 14, adaptive filter 18, 20 and open loop approximation unit 30 may form part of the same signal processing unit, e.g. forming part of the same integrated circuit. Further, in a practical implementation, the functional the tasks of the signal processor, the adaptive filter and the open loop approximation unit described in the present disclosure are largely, such as exclusively, performed by software running on a (digital signal) processor of a data processing system, e.g. implemented as part of an audio processing IC of the hearing device.

As already pointed out above, the hearing device may operate as whole band system that processes a broad frequency band or a sub-band system that processes only a sub-band of the acoustic frequency spectrum. A hearing device may comprise several sub-band systems for a plurality of sub-bands to be processed separately, as it is illustrated in principle in FIG. 2 or 4 of above referenced EP 1 191 814. Embodiments of the present invention may be applied to either type of hearing device.

REFERENCES

US 2006/0245610 A1 (SIEMENS AUDIOLOGISCHE TECHNIK) Nov. 2, 2006

WO 2006/063624 A1 (WIDEX) Jun. 6, 2006

EP 1 191 814 A1 (TOEPHOLM & WESTERMANN) Mar. 27, 2002

[Engebretson, 1993] A. Engebretson, M. French-St. George, "Properties of an adaptive feedback equalization algorithm", J. Rehabil. Res. Dev., 30(1), pp. 8-16, 1993

[Haykin, 1996] Simon Haykin, Adaptive Filter Theory, Prentice Hall, 3rd edition, 1996, ISBN 0-13-322760-X.

[Makhoul; 1975] J. Makhoul, "Linear prediction: A tutorial review", Proceedings of the IEEE, 63 (5):561-580, April 1975

The invention claimed is:

1. A hearing device for compensating hearing impairment of a user, comprising:

an input signal converter configured to convert an acoustic signal to an electric signal;

an output signal converter configured to convert a processed signal to a processed acoustic signal presented to the user;

an adaptive feedback suppression unit configured to compensate for acoustic feedback between said output signal converter and said input signal converter, said acoustic feedback being defined by an acoustic feedback transfer function, and to generate a feedback compensation signal defining an electric feedback transfer function representing an estimate of said acoustic feedback transfer function, the feedback compensation signal being mixed with said electric signal generating a compensated electric signal;

a signal processor configured to process said compensated electric signal and to generate said processed signal therefrom; and an open loop approximation unit configured to monitor a relation between said compensated electric signal and said processed signal to provide an estimate of the difference between the acoustic feedback transfer function and the electric feedback transfer function provided by the adaptive feedback suppression unit, and configured to generate a control signal based on said relation between said compensated electric signal and said processed signal, said control signal controlling said signal processor and/or said adaptive feedback suppression unit, wherein the signal processor is further configured to determine a residual acoustic feedback and/or the open loop gain based on said control signal.

2. The hearing device according to claim 1, wherein said open loop approximation unit further is configured to monitor a signal processor transfer function and to calculate open loop transfer function from a multiplication between said relation between the compensated and processed signal and the signal processor transfer function.

3. The hearing device according to claim 1, wherein said open loop approximation unit further is configured to communicate said relation between the compensated and processed signal to said signal processor, and said signal processor is further configured to calculate an open loop transfer function from a multiplication between said relation between the compensated and processed signal and a signal processor transfer function.

4. The hearing device according to claim 1, wherein said signal processor is further configured to adjust a signal processor transfer function according to said control signal.

5. The hearing device according to claim 3, wherein said signal processor is further configured to adjust a signal processor transfer function according to said open loop transfer function.

6. The hearing device according to claim 1, wherein said adaptive feedback suppression unit is further configured to adjust filter parameters according to said control signal.

7. The hearing device according to claim 6, wherein said filter parameters comprise values for controlling convergence speed of said adaptive feedback suppression unit.

8. The hearing device according to claim 1, wherein said loop approximation unit determines open loop gain and phase from the open loop transfer function.

9. The hearing device according to claim 8, wherein said loop approximation unit is configured to generate said control signal when said open loop gain is greater than 0.3.

10. The hearing device according to claim 8, wherein said loop approximation unit is configured to generate a control signal when said open loop phase is 0° or an integer number times 360°.

11. The hearing device according to claim 1, further comprising:

a filterbank for dividing said compensated electric signal into a plurality of sub-band electric signals, wherein said signal processor is further configured to concurrently process said plurality of sub-band electric signals and to mix said plurality of processed sub-band electric signals into said processed signal.

12. The hearing device according to claim 1, further comprising:

a filterbank for dividing said electric signal into a plurality of sub-band electric signals, wherein said adaptive feedback suppression unit is configured to compensate for acoustic feedback between said output signal converter and said input signal converter in each sub-band and to generate a sub-band feedback compensation signal, which is mixed with said sub-band electric signal generating a compensated electric signal for each sub-band, and said signal processor is configured to concurrently process said plurality of compensated electric signals for each sub-band and to mix said plurality of processed signals for each sub-band into said processed signal.

13. A method of operating a hearing device for compensating hearing impairment of a user, the hearing device comprising an input signal converter configured to convert an acoustic signal to an electric signal, an output signal converter configured to convert a processed signal to a processed acoustic signal presented to the user, an adaptive feedback suppression unit configured to compensate for acoustic feedback between said output signal converter and said input signal converter, and a signal processor configured to process said compensated electric signal and to generate said processed signal therefrom, the method comprising:

providing adaptive feedback suppression to compensate for acoustic feedback between said output signal converter and said input signal converter, said acoustic feedback being defined by an acoustic feedback transfer function;

generating a feedback compensation signal defining an electric feedback transfer function representing an estimate of said acoustic feedback transfer function;

mixing said feedback compensation signal with said electric signal thereby generating a compensated electric signal;

monitoring a relation between said compensated electric signal and said processed signal to provide an estimate of the difference between the acoustic feedback transfer function and the electric feedback transfer function provided by the adaptive feedback suppression unit; and generating a control signal based on said relation between said compensated electric signal and said processed signal for controlling said signal processor and/or said adaptive feedback suppression; and determining a residual acoustic feedback and/or the open loop gain based on said control signal.

14. A method according to claim 13, further comprising:

determining whether the residual acoustic feedback and/or the open loop gain is larger than a first predefined level; and modifying the adaptation speed of the generation of the feedback compensation signal based on said control signal, when it is determined that the residual acoustic feedback and/or the open loop gain is larger than the first predefined level.

15. A method according to claim 13, further comprising:

determining whether the residual acoustic feedback and/or the open loop gain is larger than a second predefined level; and modifying providing that a maximum gain Gmax that is allowed at any point in time in the signal processor based on said control signal, when it is determined that the residual acoustic feedback and/or the open loop gain is larger than the second predefined level.

16. A method according to claim 13, further comprising:

monitoring the residual acoustic feedback and/or the open loop gain is monitored over time.

17. A method according to claim 16, further comprising:

determining whether the average residual feedback and/or the average open loop gain has been larger than a third predefined level for a first predefined averaging time; and modifying a maximum gain Gmax that is allowed at any point in time in the signal processor based on the control signal, when it is determined that the average residual feedback and/or the average open loop gain has been larger than the third predefined level for the first predefined averaging time.

18. A method according to claim 16, further comprising:

determining whether the average residual feedback and/or the average open loop gain has been smaller than a fourth predefined level for a second predefined averaging time;

and modifying providing the maximum gain Gmax that is allowed at any point in time in the signal processor based on the control signal, when it is determined that the average residual feedback and/or the average open loop gain has been smaller than the fourth predefined level for the second predefined averaging time.

19. A non-transitory tangible computer-readable medium encoded with instructions, wherein the instructions, when executed on a processor of a hearing device for compensating hearing impairment of a user, the hearing device including an adaptive feedback suppression unit configured to compensate for acoustic feedback between an output signal converter and an input signal converter, cause the processor to perform the steps of a method, the method comprising:

providing adaptive feedback suppression to compensate for acoustic feedback between an output signal converter of the hearing device and an input signal converter of the hearing device, said acoustic feedback being defined by an acoustic feedback transfer function;

generating a feedback compensation signal defining an electric feedback transfer function representing an estimate of said acoustic feedback transfer function;

mixing said feedback compensation signal with said electric signal thereby generating a compensated electric signal;

monitoring a relation between said compensated electric signal and a processed signal to provide an estimate of the difference between the acoustic feedback transfer function and the electric feedback transfer function provided by the adaptive feedback suppression unit;

generating a control signal based on said relation for controlling a signal processor and/or an adaptive feedback suppression of the hearing device; and determining a residual acoustic feedback and/or the open loop gain based on said control signal.

20. A data processing system comprising a processor and program code means for causing the processor to perform the steps of the method according to claim 13.

* * * * *